US009657235B2

(12) United States Patent
Pagot et al.

(10) Patent No.: US 9,657,235 B2
(45) Date of Patent: May 23, 2017

(54) REFORMING PROCESS WITH OPTIMIZED DISTRIBUTION OF THE CATALYST

(71) Applicant: IFP Energies Nouvelles, Rueil-Malmaison (FR)

(72) Inventors: Alexandre Pagot, ST Genis Laval (FR); Eric Lemaire, Anse (FR); Heloise Dreux, Lyons (FR)

(73) Assignee: IFP Energies Nouvelles, Rueil-Malmaison (FR)

( * ) Notice: Subject to any disclaimer, the term of this patent is extended or adjusted under 35 U.S.C. 154(b) by 28 days.

(21) Appl. No.: 14/810,990

(22) Filed: Jul. 28, 2015

(65) Prior Publication Data

US 2016/0032199 A1 Feb. 4, 2016

(30) Foreign Application Priority Data

Jul. 29, 2014 (FR) ..... 14/57.315

(51) Int. Cl.

| | |
|---|---|
| ***C10G 35/00*** | (2006.01) |
| ***C10G 35/04*** | (2006.01) |
| ***C10G 35/085*** | (2006.01) |
| ***C10G 35/10*** | (2006.01) |
| ***C10G 59/02*** | (2006.01) |

(52) U.S. Cl.

CPC ..... *C10G 59/02* (2013.01)

(58) Field of Classification Search

CPC ..... C10G 35/00; C10G 35/04; C10G 35/085; C10G 35/10

USPC ..... 208/133, 134, 138

See application file for complete search history.

(56) References Cited

U.S. PATENT DOCUMENTS

| | | | | |
|---|---|---|---|---|
| 3,392,107 A * | 7/1968 | Pfefferle | ..... | C10G 35/085 208/138 |
| 6,398,947 B2 | 6/2002 | Beck et al. | | |
| 2001/0001448 A1 | 5/2001 | Kapoor et al. | | |
| 2010/0243521 A1 | 9/2010 | Peters et al. | | |

FOREIGN PATENT DOCUMENTS

| | | |
|---|---|---|
| FR | 2201338 A1 | 4/1974 |
| GB | 1424244 A | 2/1976 |
| GB | 1600928 A | 10/1981 |
| WO | 0123502 A1 | 4/2001 |

OTHER PUBLICATIONS

Search Report dated Mar. 26, 2015 issued in corresponding application FR 1457315 (pp. 1-2).

* cited by examiner

*Primary Examiner* — Thuan D Dang

(74) *Attorney, Agent, or Firm* — Millen White Zelano & Branigan, PC

(57) ABSTRACT

The invention relates to a process for catalytic reforming of a naphtha hydrocarbon feedstock using a number of reaction zones in series, wherein the reaction zones contain a reforming catalyst bed. The process comprises comprising the following stages:

sending hydrocarbon feedstock that is heated with hydrogen through the reaction zones to convert paraffinic and naphthenic compounds into aromatic compounds, with the effluent that is produced by each reaction zone, except for the last reaction zone, being heated before its introduction into the following reaction zone;

drawing off a reformate from the last reaction zone.

15 Claims, 1 Drawing Sheet

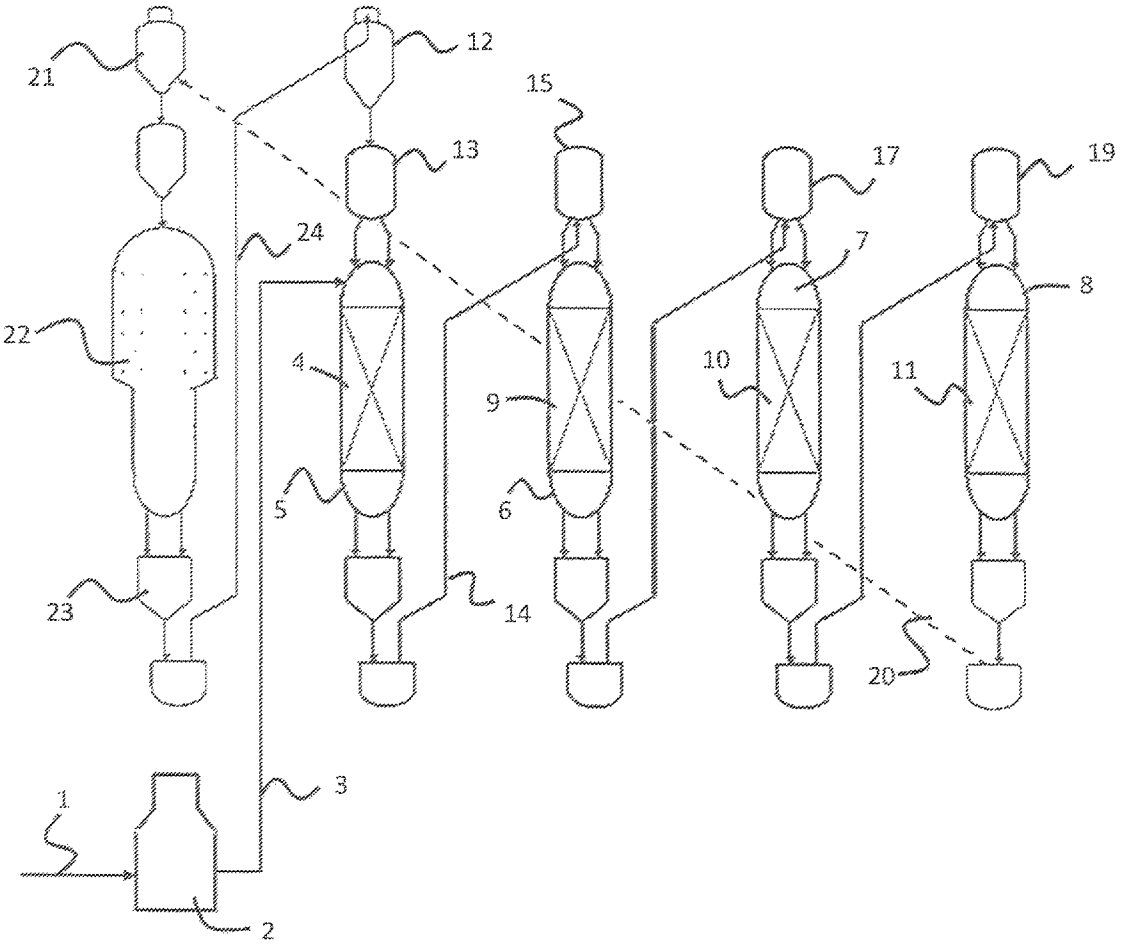
19
8
11
20
17
7
10
15
9
6
14
12
13
4
5
3
24
2
21
22
23
1

REFORMING PROCESS WITH OPTIMIZED DISTRIBUTION OF THE CATALYST

This invention relates to a process for conversion of a naphtha-type hydrocarbon feedstock and in particular a process for catalytic reforming making it possible to transform the paraffinic compounds and/or the naphthenes of the naphtha feedstock into aromatic compounds.

STATE OF THE ART

The reforming (or catalytic reforming) of naphtha-type hydrocarbon fractions is well known in the refining field. From these hydrocarbon fractions, this reaction makes it possible to produce bases for fuel with a high octane number and/or aromatic fractions for petrochemistry, while providing to the refinery the hydrogen that is necessary for other operations.

The process for catalytic reforming consists in bringing into contact the hydrocarbon fraction that contains paraffinic compounds and naphthenes with hydrogen and a reforming catalyst, for example with platinum, and in converting the paraffinic compounds and the naphthenes into aromatic compounds with an associated production of hydrogen. Since the reactions involved in the reforming process (reactions of isomerization, dehydrogenation and dehydrocyclization) are endothermic, it is advisable to heat the effluent drawn off from a reactor before sending it into the following reactor.

Over time, the reforming catalyst deactivates because of the coke deposit on its active sites. Consequently, it is necessary—so as to maintain an acceptable productivity of the reforming unit—to regenerate the catalyst so as to eliminate the deposit and thus to reestablish its activity.

There are various types of reforming processes. The first type relates to so-called "non-regenerative" processes; the catalyst remains on line during long periods but its activity drops over time, which makes it necessary to raise the temperature of the reactors gradually and therefore to have a variable selectivity during the operating cycle. The reactors are necessarily all switched off, which totally interrupts the production of the refinery so as to regenerate the catalyst before another production cycle. According to another so-called "semi-regenerative" catalytic reforming process, the catalyst is often regenerated in the case where several reactors that contain the fixed-bed catalyst are used. One of the reactors is undergoing regeneration while the other reactors are on line; it then replaces one of the reactors on line when the catalyst of the latter is to be regenerated, and in this way, all of the reactors are alternately taken off line for regeneration and then put back on line without the operation of the unit being interrupted.

Finally, there is the reforming process said to be "of continuous regeneration of the catalyst" (CCR, Continuous Catalytic Reforming according to the English terminology) that implies that the reaction is conducted in a reactor in which the catalyst continually flows from top to bottom, and the regeneration is done continuously in an attached reactor, with the catalyst being recycled in the primary reactor in such a way as not to interrupt the reaction. It will be possible to refer to the document FR 2 160 269 that discloses a catalytic reforming process with continuous regeneration of the catalyst involving multiple radial moving-bed reactors in series and a dedicated regenerator. According to the process FR 2 160 269, the hydrocarbon fraction mixed with hydrogen is treated successively in each of the reactors in series while the catalyst continuously passes into all of the reactors. The recovered catalyst exiting from the final reactor is sent to be regenerated in the regenerator at the outlet of which the regenerated catalyst is gradually reintroduced into the first reforming reactor.

Because of the endothermicity of the reactions that are involved, it is necessary to heat the effluent of a reactor before its input into the following reactor so as to maintain a high enough mean temperature so that the conversion reactions take place.

In the state of the art, the document FR 1 488 964 is known, which document teaches a catalytic reforming process using at least three reactors in series with intermediate reheating of the effluents and in which the last reactor comprises approximately 55% of the total weight of catalyst while the preceding reactors share the remainder of the catalyst in an essentially equal way. This document proposes in particular putting at least 10% of the total weight of catalyst into the first reactor.

One object of the invention is to propose a reforming process using several reactors in series and for which the distribution of the catalyst in the reactors is optimized so as to maintain an optimal mean temperature in all of the catalytic beds for promoting the reforming reactions.

SUMMARY OF THE INVENTION

The invention therefore relates to a process for catalytic reforming of a naphtha hydrocarbon feedstock using a number of reaction zones in series, with said reaction zones containing a reforming catalyst bed. The process comprises the following stages:

The hydrocarbon feedstock that is heated with hydrogen is sent through the reaction zones to convert paraffinic and naphthenic compounds into aromatic compounds, with the effluent that is produced by each reaction zone except for the last reaction zone being heated before its introduction into the following reaction zone;

A reformate is drawn off from the last reaction zone.

The first reaction zone is operated under the following conditions:

A mean temperature of between 470 and 570° C.;

A pressure of between 0.3 and 1.5 MPa;

A ratio (mass flow rate of feedstock/catalyst mass) of between 50 and 200 $h^{-1}$;

The $H_2$/hydrocarbon molar ratio of between 0.8 and 8;

A quantity of catalyst of between 1 and 5% by weight of the total quantity of catalyst used.

By limiting the quantity of catalyst in the first reaction zone, the phenomenon of endothermicity and therefore the drop in temperature in this zone are also limited, which consequently makes it possible to control the drops in temperature undergone in the subsequent catalytic reaction zones. In addition, the use of the catalyst is optimized in this first zone by reducing the quantity of catalyst that is exploited poorly or very little.

Owing to a better monitoring of the endothermicity in the different reaction zones, the activity of the catalyst that is directly linked to the mean temperature in the reaction zones is also improved. Thus, with the iso-quantity of catalyst that is used, the process according to the invention has a better yield of the reformate ($C5^+$) that is produced.

The process according to the invention is used with an overall ratio (mass flow rate of feedstock/total catalyst mass) of between 1 and 10 $h^{-1}$ and preferably between 1.5 and 5 $h^{-1}$.

Preferably, the process according to the invention uses at least four reaction zones. In a very preferred manner, the process relies on five reaction zones.

According to one embodiment, the reaction zones have a catalytic moving bed.

According to a preferred embodiment, the process uses the so-called "continuous regeneration of the catalyst" technology that uses catalytic moving beds in the reaction zones. In this embodiment, the reformate and the catalyst are then drawn off separately from the last reaction zone, and the catalyst that is obtained from the last reaction zone is sent into a regenerator, and finally, at least a portion of the regenerated catalyst that is obtained from the regenerator is transferred into the first reaction zone.

According to the embodiment that is called "catalytic moving bed," the reaction zones are placed respectively in reactors that are arranged side-by-side.

In an alternative manner, the reaction zones are placed in a vertical stack in a reactor in such a way that the catalyst flows by gravity from one reaction zone into the next.

According to another embodiment that is an alternative to the "catalytic moving bed," the reaction zones comprise a catalytic fixed bed. For example, the reaction zones are placed respectively in reactors arranged side-by side or are placed in a vertical stack in a reactor.

In a preferred manner, the last reaction zone contains at least 30% by weight of the total quantity of catalyst.

According to a particular embodiment, when the process is used in four reaction zones, the quantity of catalyst in the second reaction zone is between 10 and 25% by weight of the total quantity of catalyst, the quantity of catalyst in the third reaction zone is between 25 and 35% by weight of the total quantity of catalyst, and the quantity of catalyst in the fourth reaction zone is between 35 and 64% by weight of the total quantity of catalyst, it being understood that the total quantity of catalyst in the four reaction zones is 100% by weight.

According to a preferred embodiment, the process uses five reaction zones, the quantity of catalyst in the second reaction zone is between 7 and 15% by weight of the total quantity of catalyst, the quantity of catalyst in the third reaction zone is between 15 and 20% by weight of the total quantity of catalyst, the quantity of catalyst in the fourth reaction zone is between 20 and 30% by weight of the total quantity of catalyst, and the quantity of catalyst in the fifth reaction zone is between 30 and 57% by weight of the total quantity of catalyst, it being understood that the total quantity of catalyst in the five reaction zones is 100% by weight.

DETAILED DESCRIPTION OF THE INVENTION

Other characteristics and advantages of the invention will be better understood and will be revealed clearly from reading the description given below with reference to FIG. 1, which is a simplified schematic diagram of the process according to the invention.

BRIEF DESCRIPTION OF DRAWINGS

FIG. 1 shows a schematic diagram of the catalytic reforming process according to the invention that uses four reaction zones placed respectively in four reactors arranged in series and side-by-side. FIG. 1 also indicates that the reactors have a catalytic moving bed with a continuous regeneration of the catalyst that is conducted in a dedicated regenerator.

The gaseous hydrocarbon feedstock that is treated by the process is in general a naphtha fraction that distills between 60 and 220° C. and that contains paraffinic compounds and naphthenes. The naphtha feedstock is obtained from, for example, the atmospheric distillation of crude or a condensate of natural gas. The process according to the invention is also applied to heavy naphthas produced by a unit for catalytic cracking (catalytic cracking fluid FCC according to the English terminology), coking, hydrocracking, or else steam-cracking gasoline.

With reference to FIG. 1, the hydrocarbon feedstock is sent via the line 1 into a heating means 2 (for example, a furnace) and then channeled via the line 3 into a first reaction zone 4 arranged in a first reactor 5. The feedstock that has been heated to a temperature that is in general between 450 and 570° C. is introduced at the top of the reactor 5 and exits from it by the bottom to be reintroduced at the top of the second reactor 6 comprising a second reaction zone 9, and so on in the third and fourth reactors 7, 8 that respectively comprise third and fourth reaction zones 10, 11. It should be noted that the path of the feedstock has not been depicted in order to declutter the figure. Furthermore, between each reactor, the feedstock passes through a heating means (not shown) so as to bring it to a temperature of between 450 and 570° C. in each reactor.

As indicated in FIG. 1, the catalyst that is stored in a hopper 12 is introduced into a reduction reactor 13 where it undergoes a reduction stage before being directed into the top of the first reactor 5. The catalyst flows into the first reactor 5 by gravity and exits from it via the bottom. The catalyst is then sent by means of a lift via the line 14 into a hopper 15 located above the second reactor 6. The catalyst is reintroduced at the top of the second reactor 6 from where it flows by gravity. The catalyst also proceeds in the same way between the second reactor 6 and the third reactor 7 and then enters the third reactor 7 and the fourth reactor 8.

The spent catalyst that is recovered at the bottom of the fourth reactor 8 is then transferred via the line 20 into a storage hopper 21 placed above a catalyst regenerator 22. The spent catalyst flows by gravity into the regenerator 22 where it undergoes the successive stages of combustion, oxychlorination, and finally calcination so as to reestablish its catalytic activity. The regenerator 22 can be, for example, a regenerator as described in the documents FR 2 761 909 and FR 2 992 874. Finally, a portion of the regenerated catalyst that is stored in the lower hopper 23 is sent, via the line 24, into the hopper 12 above the first reactor 5.

According to an alternative, the process according to the invention can use reaction zones with catalytic fixed beds, each reaction zone being contained respectively in a reactor.

It is also possible according to a variant to place the reaction zones in a vertical stack in a single reactor with the first reaction section located at the top of said reactor in such a way that the feedstock and the catalyst flow in a downward manner from one reaction zone to the next.

The process according to the invention involves a number of reaction zones so as to carry out the conversion of paraffinic and naphthenic compounds contained in the hydrocarbon feedstock into aromatic compounds. With the reactions that are involved being endothermic, this requires that the effluent exiting from a reaction zone be heated in advance before entering the next reaction zone.

A significant drop in the mean temperature in the reaction zone was noted in the first reaction zone where primarily the reaction for conversion of naphthenes into aromatic compounds (by dehydrogenation), which is a fast and greatly endothermic reaction, takes place. This drop in temperature undergone in said first reaction zone has as its consequence that a portion of the catalyst ends up operating under sub-optimal temperature conditions. In some cases, when the quantity of catalyst used in the first reaction zone is greater than 10% by weight of the total quantity of catalyst, a portion of the catalyst is then present in a superfluous manner because it participates very little or not at all in the catalytic reaction.

In accordance with the invention, the first reaction zone, which can comprise either a catalytic fixed bed or a catalytic moving bed, contains between 1 to 5% by weight of catalyst relative to the total weight of catalyst used in all of the reaction zones.

In the first reaction zone, the hydrocarbon feedstock is brought into contact with the catalyst and the hydrogen under the following operating conditions:

A mean inlet temperature in the reaction zone of between 470 and 570° C.;

A pressure of between 0.3 and 1.5 MPa;

A ratio of the mass flow rate of the feedstock to the catalyst mass of between 50 and 200 $h^{-1}$;

An $H_2$/hydrocarbon molar ratio of between 0.8 and 8.

According to the invention, and when the process involves four reaction zones placed in series, the effluent that is obtained exiting from the first reaction zone is sent, after passing into a heating means, with hydrogen into the second reaction zone that includes a catalyst bed (moving or fixed) that can comprise between 10 and 25% by weight of catalyst relative to the total weight of catalyst used in all of the reaction zones. The second reaction zone is operated under the following conditions:

A mean inlet temperature in the reaction zone of between 470 and 570° C.;

A pressure of between 0.3 and 1.5 MPa.

The effluent that is obtained from the second reaction zone is subsequently treated in a third reaction zone after passing into a heating means where it is brought into contact with hydrogen and the catalyst bed. In accordance with the invention, the catalytic bed of the third reaction zone can comprise between 25 and 35% by weight of catalyst relative to the total weight of catalyst used in all of the reaction zones. The third reaction zone is operated under the following conditions:

A mean inlet temperature in the reaction zone of between 470 and 570° C.;

A pressure of between 0.3 and 1.5 MPa.

Finally, the effluent that is obtained from the third reaction zone is sent after heating with hydrogen into the fourth reaction zone including a catalyst bed comprising at least 35% by weight and preferably between 35 and 65% by weight of catalyst relative to the total weight of catalyst used in all of the reaction zones. This reaction stage is in general carried out under the following conditions:

A mean inlet temperature in the reaction zone of between 470 and 570° C.;

A pressure of between 0.3 and 1.5 MPa.

According to a very preferred embodiment, the process involves five reaction zones placed in series with distributions into the following catalysts:

$1^{st}$ reaction zone: 1-5% by weight of the total quantity of catalyst used $2^{nd}$ reaction zone: 7-15% by weight of the total quantity of catalyst used $3^{rd}$ reaction zone: 15-20% by weight of the total quantity of catalyst used $4^{th}$ reaction zone: 20-30% by weight of the total quantity of catalyst used $5^{th}$ reaction zone: 30-57% of the total quantity of catalyst used The reaction zones (of the $2^{nd}$ to the $5^{th}$) are also operated under the following conditions:

A mean inlet temperature in the reaction zone of between 470 and 570° C.;

A pressure of between 0.3 and 1.5 MPa.

In addition, the process according to the invention is conducted with an overall ratio (mass flow rate of hydrocarbon feedstock/total catalyst mass used) of between 1 and 10 $h^{-1}$, preferably between 1.5 and 5 $h^{-1}$.

The reforming catalyst used in the process according to the invention in general comprises a porous substrate, platinum, and a halogen. Preferably, the catalyst comprises platinum and chlorine with an alumina substrate. The catalyst can also comprise other elements (promoters) that are selected from among: Re, Sn, In, P, Ge, Ga, Bi, B, Ir, rare earths, or any combination of these elements.

In a general manner, the platinum content is between 0.01 and 5% by weight of platinum relative to the total weight of catalyst and preferably between 0.1 and 1% by weight of platinum relative to the total weight of catalyst.

Although halogen can be selected from among chlorine, bromine, fluorine and iodine, chlorine is preferable for providing the acidity that is necessary to the catalyst. The halogen represents, expressed in terms of elements, between 0.5 and 1.5% by weight relative to the total weight of catalyst.

Preferably, the process according to the invention is carried out in reactors in series placed side by side that rely on a flow of the so-called "moving-bed" catalyst, i.e., a slow flow by gravity of the catalyst particles. In general in this type of reactor, the particles are confined in an annular chamber that is limited either by the wall of the reactor or by a cylindrical casing that consists of a series of filtration pipes (or scallops according to the English terminology) and an interior pipe that corresponds to the central collector making possible the collection of effluents.

More specifically in this type of so-called "radial moving-bed" reactor, the feedstock is in general introduced via the external periphery of the catalytic annular bed and passes through the latter in a manner that is essentially perpendicular to the vertical direction of the reactor, and the reaction effluents are recovered in the central collector. Concomitantly, the catalyst particles that drop by gravity along the annular bed are evacuated from the reactor by means of pipes (or catalyst draw-off leg).

Although in a preferred manner, the process according to the invention uses radial-flow moving-bed reactors, it is quite conceivable to use catalytic fixed-bed reactors.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding application No. FR 14/57.315, filed Jul. 29, 2014, are incorporated by reference herein.

EXAMPLES

Example 1

Not in Accordance with the Invention

In Example 1, a hydrocarbon feedstock is treated in four reaction zones placed in series in four reactors, with the first reaction zone containing a quantity of catalyst that is greater than 5% by weight of the total quantity of catalyst used. The distribution of the catalyst in the reactors is as follows: 10%/20%/30%/40% by weight relative to the total weight of catalyst. The total quantity of catalyst is 100 tons.

Table 1 provides the composition of the hydrocarbon feedstock (initial boiling point 100° C., final boiling point 165° C.):

TABLE 1

| | | |
|---|---|---|
| Feedstock Composition (% by Weight) | Paraffins | 54 |
| | Olefins | 0 |
| | Naphthenes | 33 |
| | Aromatic Compounds | 13 |
| | RON | 47 |
| | Flow Rate (t/h) | 200 |

The overall ratio (mass flow rate of feedstock/total catalyst mass), i.e. (200 tons of hydrocarbon feedstock per hour/100 tons of catalyst), is 2 $h^{-1}$.

The catalyst that is used in the reactors comprises a substrate such as chlorinated alumina or platinum and is enhanced with tin.

The feedstock that is heated to 520° C. is thus treated successively in the four reactors with an intermediate heating of the effluent to 520° C. before its introduction into the next reaction zone.

The operating conditions in the four reaction zones are provided in Table 2. These conditions have been selected to produce a reformate that is recovered exiting from the fourth reactor whose RON (Research Octane Number according to the English terminology) number is at least equal to 102.

TABLE 2

| | Reactor 1 | Reactor 2 | Reactor 3 | Reactor 4 |
|---|---|---|---|---|
| Temperature Entering the Reactor (° C.) | 520 | 520 | 520 | 520 |
| Pressure (MPa) | 0.69 | 0.65 | 0.60 | 0.55 |
| Mass Flow Rate of Feedstock/Catalyst Mass Ratio ($h^{-1}$) | 20.0 | 10.0 | 6.7 | 5.0 |
| $H_2$/Hydrocarbon Molar Ratio (mol/mol) | 1.5 | — | — | — |

Example 2

Not in Accordance with the Invention

Example 2 is similar to Example 1 except that the hydrocarbon feedstock is treated in five reactors arranged in series with the following distribution of catalysts: 10%/10%/10%/20%/30% by weight relative to the total weight of catalyst. The total quantity of catalyst is 100 tons for treating a flow rate of hydrocarbon feedstock of 200 t/h. The overall ratio (mass flow rate of feedstock/total catalyst mass), i.e. (200 tons of hydrocarbon feedstock per hour/100 tons of catalyst), is 2 $h^{-1}$. The $H_2$/hydrocarbon molar ratio (mol/mol) is set at 1.5 in the first reactor.

As in Example 1, the feedstock and the effluent of a reaction zone are heated to 520° C. before entering the next reaction zone.

Table 3 provides the operating conditions used in the five reactors.

TABLE 3

| | Reactor 1 | Reactor 2 | Reactor 3 | Reactor 4 | Reactor 5 |
|---|---|---|---|---|---|
| Temperature Entering the Reactor (° C.) | 520 | 520 | 520 | 520 | 520 |
| Pressure (MPa) | 0.74 | 0.69 | 0.65 | 0.60 | 0.55 |
| Mass Flow Rate of Feedstock/Catalyst Mass Ratio ($h^{-1}$) | 20.0 | 20.0 | 20.0 | 10 | 6.7 |
| $H_2$/Hydrocarbon Molar Ratio (mol/mol) | 1.5 | — | — | — | — |

Example 3

According to the Invention

Example 3 corresponds to Example 1 except that the hydrocarbon feedstock is treated in five reactors placed in series with the following catalyst distribution: 2%/10%/20%/30%/38% by weight relative to the total catalyst weight. The total quantity of catalyst is 100 tons for treating a flow rate of hydrocarbon feedstock of 200 t/h. The overall ratio (mass flow rate of feedstock/total catalyst mass), i.e. (200 tons of hydrocarbon feedstock per hour/100 tons of catalyst), is 2 $h^{-1}$.

As in Example 1, the feedstock and the effluent of a reaction zone are heated to 520° C. before entering into the following reaction zone.

The operating conditions in the reaction zones of the reactors are combined in Table 4 below:

TABLE 4

| | Reactor 1 | Reactor 2 | Reactor 3 | Reactor 4 | Reactor 5 |
|---|---|---|---|---|---|
| Temperature Entering the Reactor (° C.) | 520 | 520 | 520 | 520 | 520 |
| Pressure (MPa) | 0.74 | 0.69 | 0.65 | 0.60 | 0.55 |
| Mass Flow Rate of Feedstock/Catalyst Mass Ratio ($h^{-1}$) | 100.0 | 20.0 | 10.0 | 6.7 | 5.26 |
| $H_2$/Hydrocarbon Molar Ratio (mol/mol) | 1.5 | — | — | — | — |

Table 5 provides the mean temperature of catalytic beds of different reactors.

TABLE 5

| | Example 1 (Not in Accordance with the Invention) | Example 2 (Not in Accordance with the Invention) | Example 3 (According to the Invention) |
|---|---|---|---|
| Reactor 1 | 414 | 414 | 421 |
| Reactor 2 | 452 | 463 | 460 |
| Reactor 3 | 469 | 480 | 470 |

TABLE 5-continued

| | Example 1 (Not in Accordance with the Invention) | Example 2 (Not in Accordance with the Invention) | Example 3 (According to the Invention) |
|---|---|---|---|
| Reactor 4 | 486 | 481 | 483 |
| Reactor 5 | — | 496 | 498 |

Thus, by using the process according to the invention, i.e., by limiting the quantity of catalyst in the first reaction zone to a value of between 1 and 5% by weight relative to the total weight of catalyst, the endothermy is limited in this reaction zone and ultimately the overall endothermy of the reforming unit.

Since the activity of the catalyst is based on the mean temperature in the catalytic bed, by limiting the drop in temperature, the yield of compounds in aromatic compounds is consequently improved, as indicated in Table 6.

TABLE 6

| | Example 1 (Not in Accordance with the Invention) | Example 2 (Not in Accordance with the Invention) | Example 3 (According to the Invention) |
|---|---|---|---|
| Mass Flow Rate of Feedstock/Total Catalyst Mass ($h^{-1}$) | 2 | 2 | 2 |
| Reformate Yield (C5+) (% by Weight) | 91.8 | 90.9 | 90.7 |
| Yield of Aromatic Compounds (% by Weight) | 72.1 | 75.0 | 75.3 |
| RON of the Reformate | 102 | 104.2 | 104.4 |

This increase in temperature in the catalytic beds greatly impacts the activity of the catalyst. For the same quantity of catalyst as illustrated above, the gain in production of aromatic compounds makes possible an improvement of the RON by 2.4 points in the case of Example 3 relative to Example 1 and an improvement of 0.2 point of RON in the case of Example 3 relative to Example 2.

Example 4

According to the Invention

Example 4 corresponds to Example 3 with the same distributions of catalysts in the five reactors. By contrast, the total quantity of catalyst has been fixed at 42 tons for a feedstock flow rate of 200 t/h so as to obtain a RON index of the reformate ($C5^+$) of at least 102. Table 7 compares the yields of reformate ($C5^+$) and of aromatic compounds of Examples 1 and 4.

TABLE 7

| | Example 1 (Not in Accordance with the Invention) | Example 4 (According to the Invention) |
|---|---|---|
| Feedstock Flow Rate/Total Quantity of Catalyst ($h^{-1}$) | 2 | 4.8 |
| Reformate Yield (C5+) (% by Weight) | 91.8 | 92.2 |

TABLE 7-continued

| | Example 1 (Not in Accordance with the Invention) | Example 4 (According to the Invention) |
|---|---|---|
| Yield of Aromatic Compounds (% by Weight) | 72.1 | 72.6 |
| RON of the Reformate | 102 | 102 |

The process according to the invention makes it possible to produce a reformate with a high RON index while using a smaller amount of catalyst. The increase by 0.4% by weight of the reformate yield of the unit is undoubtedly linked to a lower hydrocracking rate owing to the use of a smaller amount of catalyst.

It is also noted that the yield of aromatic compounds of Example 4 is improved relative to that of Example 1 (not in accordance with the invention).

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for catalytic reforming of a naphtha hydrocarbon feedstock using five reaction zones in series, with said reaction zones containing a reforming catalyst bed, with the process comprising the following stages:

a) heating said hydrocarbon feedstock with hydrogen and sending said hydrocarbon feedstock through said five reaction zones to convert paraffinic and naphthenic compounds into aromatic compounds, with the effluent produced by each reaction zone except for the last reaction zone being heated before introduction of the effluent into the following reaction zone; and b) drawing off a reformate from the last reaction zone, wherein the reaction in the first reaction zone is performed under the following conditions:

A mean temperature of between 470 and 570° C.;

A pressure of between 0.3 and 1.5 MPa;

A ratio of mass flow rate of feedstock to total catalyst mass of between 50 and 200 $h^{-1}$;

An $H_2$/hydrocarbon molar ratio of between 0.8 and 8;

A quantity of catalyst of between 1 and 5% by weight of the total quantity of catalyst used;

wherein the quantity of catalyst in the second reaction zone is between 7 and 15% by weight of the total quantity of catalyst, the quantity of catalyst in the third reaction zone is between 15 and 20% by weight of the total quantity of catalyst, the quantity of catalyst in the fourth reaction zone is between 20 and 30% by weight of the total quantity of catalyst, and the quantity of catalyst in the fifth reaction zone is between 30 and 57% by weight of the total quantity of catalyst.

2. The process according to claim 1, wherein the overall ratio of mass flow rate of feedstock to total catalyst mass is between 1 and 10 $h^{-1}$.

3. The process according to claim 2, wherein the overall ratio of mass flow rate of feedstock to total catalyst mass is between 1.5 and 5 $h^{-1}$.

4. The process according to claim 1, wherein the second through fifth reaction zones are operated at:

A mean temperature of between 470 and 570° C.;

A pressure of between 0.3 and 1.5 MPa.

5. The process according to claim 1, wherein each of the reaction zones has a catalytic moving bed.

6. The process according to claim 5, wherein:

The reformate and the catalyst are drawn off separately from the last reaction zone;

The catalyst obtained from the last reaction zone is sent into a regenerator; and At least a portion of the regenerated catalyst obtained from the regenerator is transferred into the first reaction zone.

7. The process according to claim 1, wherein the reaction zones are placed respectively in reactors that are arranged side-by-side.

8. The process according to claim 1, wherein the reaction zones are placed in a vertical stack in a reactor in such a way that the catalyst flows by gravity from one reaction zone into the next.

9. The process according to claim 1, wherein each of the reaction zones comprises a catalytic fixed bed.

10. The process according to claim 9, wherein the reaction zones are placed respectively in reactors that are arranged side-by-side.

11. The process according to claim 9, wherein the reaction zones are placed in a vertical stack in a reactor.

12. The process according to claim 1, wherein the quantity of catalyst in the first reaction zone is between 2 and 5% by weight of the total quantity of catalyst used.

13. The process according to claim 1, wherein the quantity of catalyst in the second reaction zone is between 10 and 15% by weight of the total quantity of catalyst used.

14. The process according to claim 1, wherein the quantity of catalyst in the fifth reaction zone is between 38 and 57% by weight of the total quantity of catalyst used.

15. The process according to claim 1, wherein catalyst contains a porous substrate, platinum, and halogen, where in the platinum content is between 0.01 and 5% by weight relative to the total weight of the catalyst, and the halogen content is between 0.5 and 15% by weight relative to the total weight of the catalyst.

* * * * *